US006302098B1

(12) United States Patent
Smith

(10) Patent No.: US 6,302,098 B1
(45) Date of Patent: Oct. 16, 2001

(54) OVEN DOOR LATCH ASSEMBLY

(75) Inventor: Donald E. Smith, Smithville, TN (US)

(73) Assignee: France/Scott Fetzer Company, Fairview, TN (US)

( * ) Notice: Subject to any disclaimer, the term of this patent is extended or adjusted under 35 U.S.C. 154(b) by 0 days.

(21) Appl. No.: 09/571,816

(22) Filed: May 16, 2000

(51) Int. Cl.[7] ..... F24C 15/02; E05C 19/10

(52) U.S. Cl. ..... 126/197; 292/109; 292/127; 292/DIG. 69

(58) Field of Search ..... 126/197; 292/DIG. 69, 292/11, 30, 56, 109, 110, 127

(56) References Cited

U.S. PATENT DOCUMENTS

Re. 27,545 1/1973 Guy .
3,125,365 * 3/1964 Eigelbach ..... 126/197
3,859,979 1/1975 Gilliom .
4,374,320 2/1983 Barnett .
5,029,910 * 7/1991 Genbauffe et al. ..... 292/DIG. 69

* cited by examiner

*Primary Examiner*—Sara Clarke
(74) *Attorney, Agent, or Firm*—Wood, Herron & Evans, L.L.P.

(57) ABSTRACT

A motorized door latch assembly for locking an oven door in a locked and sealed position for purposes of cleaning the oven. A motor and cam cause a latch rod extending from front to back to translate, causing a latch plate to move between three different positions. In one position the latch plate prevents the oven door from opening. In another position the latch plate is pulled inwardly so the oven door is in a locked and sealed position. In its locked and sealed position the door may be opened by biasing the latch plate against the bias of a biaser extending between a fixed location on a mounting plate and a fixed location on the latch plate.

10 Claims, 4 Drawing Sheets

OVEN DOOR LATCH ASSEMBLY

FIELD OF THE INVENTION

This application relates to a motorized oven door latch assembly for locking an oven door in a closed position when the oven is in a self-cleaning mode.

BACKGROUND OF THE INVENTION

Self-cleaning ovens which are incorporated into self-standing ranges are well known. Such ovens conventionally have an oven door which is hingedly secured to a range body. The oven door may be opened to gain access to an oven cavity. The oven door may also be closed to close the opening for cooking objects placed in the cavity or cleaning the cavity. One or more heating elements reside in the oven cavity for cooking purposes.

Motorized latches which are used to lock oven doors in a closed position so that the oven cavity may be self cleaned are well known. U.S. Pat. No. 3,8659,979 and U.S. Pat. No. RE. 27,545 and U.S. Pat. No. 4,374,320 all disclose such motorized self-cleaning oven door latches. Such oven door latches are activated by a rotary motor located at the rearward portion of the range above the oven. Activation of the motor causes a rod to translate which results in a device at the front of the rod to engage the oven door so that the oven door may not be opened. After the cleaning has occurred, the motor is reactivated, causing the device at the front of the rod to disengage the oven door so that the oven door may be opened.

Using such a motorized latch, when the oven door is locked in a closed position for purposes of self cleaning the oven, the user may not access the oven cavity through the opening covered by the oven door until the motor is reactivated, and the rod translates back to its original position. In the event of an electrical or mechanical failure which prevents the motor from being reactivated, the oven door remains in a locked position such that access to the range cavity is not available except through the rear of the range. With the oven door locked shut, the oven may not be used. In such an event, a service technician must be called to enter the range through the rear of the oven and open the door. The service technician must physically move the range and then use special tools to disassemble the rear of the range to gain access to the oven cavity to open the oven door This process is costly for the range owner and time-consuming. If no service technician is available such as on a Sunday, the oven may not be used for cooking purposes until the service technician comes on Monday to open the oven door. Consequently, a need exists for a motorized latch assembly for a self-cleaning oven which enables a user to open the oven door in the event of an electrical or mechanical failure when the oven is in a self-cleaning mode.

Therefore it has been one objective of the present invention to provide a motorized oven door latch assembly which in the event of failure allows access to the oven through the oven door.

It has further been an objective of the present invention to provide an oven door latch which does not require that the rear of the range be disassembled in the event of failure.

It has further been an objective of the present invention to provide an oven door latch assembly which has a latch at the front of the oven which may be opened with a pry bar type of device in the event of failure, quickly and easily.

SUMMARY OF THE INVENTION

The invention of this application which accomplishes these objectives comprises a motorized door latch assembly for locking an oven door in a closed and sealed position so as to close an oven cavity for purposes of cleaning the oven cavity. The oven door is hingedly mounted on a range body and moveable between an open position, a closed position and a closed and sealed position.

The door latch assembly comprises a mounting plate supported by the range body above the oven cavity and extending generally from front to back. Proximate the front of the mounting plate is a pin extending upwardly from the mounting plate. The pin may be intricately formed with the mounting plate or a separate element secured to the mounting plate in any number of ways, including, but not limited to, being welded to the mounting plate.

Proximate the rear of the mounting plate, a motor is supported by the range body. The motor is preferably located above and behind the range cavity but may be located at any other location. The motor rotatively drives a cam, operatively associated with the motor.

A latch rod, having a pair of opposed ends, extends between the cam and a latch plate located at the front of the range. The latch rod has a first end secured to the rotatable cam and a second end secured to a latch plate. Rotation of the cam causes the latch rod to translate either forwardly or rearwardly. Other devices, such as for example a solenoid, may be used to cause the latch rod to translate.

The latch plate has a hook at one end for engaging the oven door and a hole at the other end. The second end of the latch rod passes through the hole of the latch plate and through a guide formed in the mounting plate so as to secure the second end of the latch rod to the latch plate and limit movement of the latch plate upon translation of the latch rod. The latch plate also has a slot therethrough in which the pin extending upwardly from mounting plate travels. The size of the slot and location of the pin restrict the movement of the latch plate so as to move the latch plate between three desired positions.

In operation, rotation of the cam by activation of the motor causes the latch rod to translate generally from back to front and causes the latch plate to move between three positions: a first position, a second position and a third position. In the first position, the latch plate is located such that the oven door may be opened. Upon translation of the latch rod, the latch plate moves to a second position in which the hook of the latch plate engages the oven door to prevent the oven door from being opened. In the third position, the latch plate is pulled inwardly by the latch rod, pulling the oven door into a locked and sealed position.

A biaser extends between a fixed point on the mounting plate and the latch plate so as to bias the latch plate towards the second position described hereinabove. In the event of a failure while the oven is in a self-cleaning mode with the latch plate in its third position and the door locked and sealed, a user, using a pry bar tool may exert pressure on the hook of the latch plate causing the latch plate to rotate about the pin of the mounting plate toward the first position. With the latch plate pulled over to its first position the oven door may be opened without having to call a service technician.

DETAILED DESCRIPTION OF THE DRAWINGS

Figure 1:
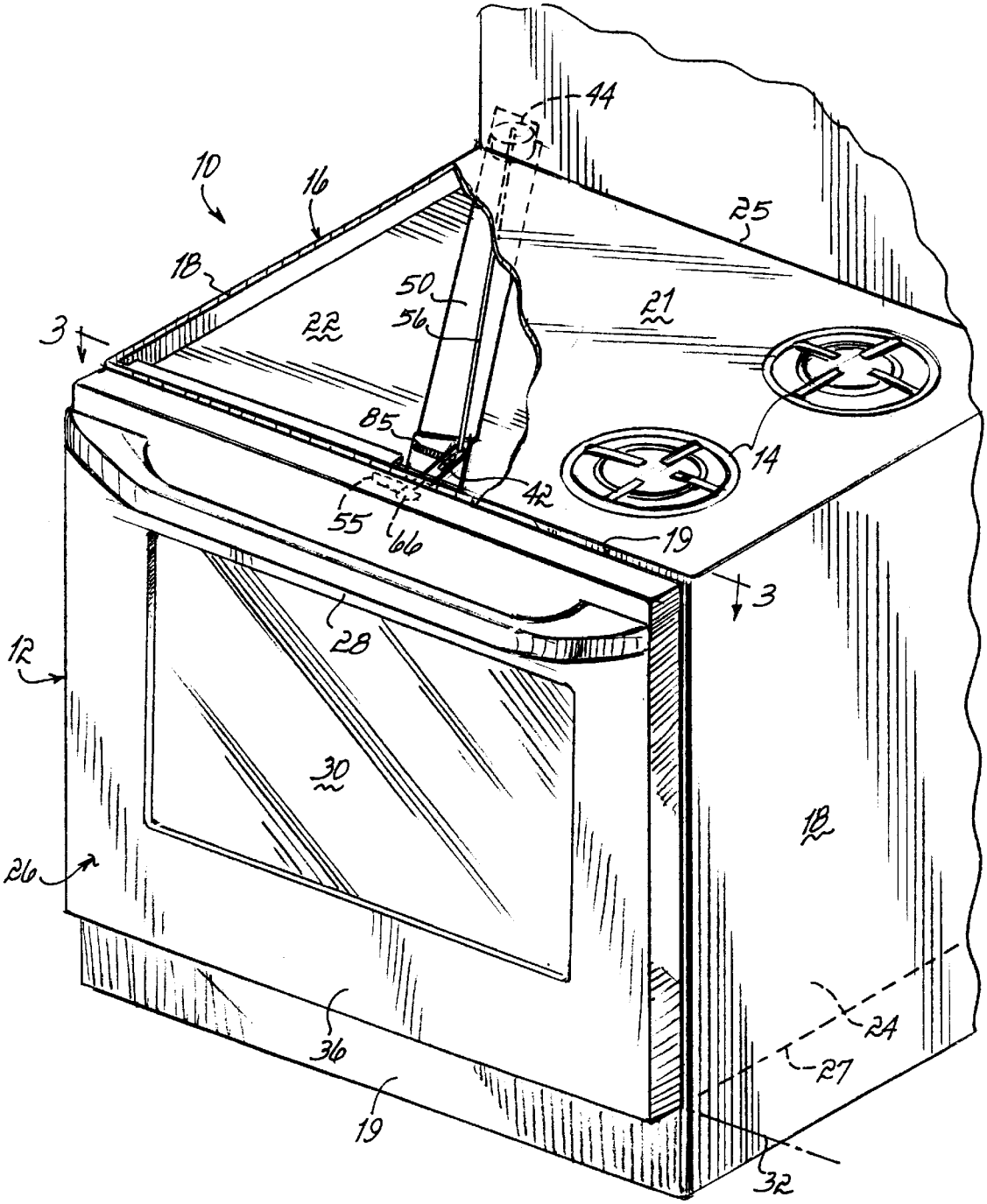
FIG. 1 is a perspective of a self-standing range built in accordance with the present invention with a portion cut away.

Referring to the drawings, and particularly to FIG. 1, there is illustrated a self-standing range 10 including a pyrolytic self-cleaning oven 12 on top of which are a plurality of burners 14 as is conventional. The range 10 comprises a range body 16 having a pair of side walls 18, a front wall 19, a back wall 20 (see FIG. 3) and a top 21. Spaced a fixed distance below the top 21 of the range body 16 is an oven top wall 22. An oven cavity 24 inside which resides one or more heating elements (not shown) is defined by the oven top wall 22, side walls 18 of the range body, a cavity back wall 25 and a bottom 27. An oven door 26 having a handle 28 and a window 30 is hingedly mounted to the front wall 19 of the range body so that a user pulling on the handle 28 will cause the oven door 26 to hingedly open about an horizontal axis 32 in order to move the door 26 between a closed position as shown in FIG. 1 and an open position. As best illustrated in FIGS. 2–4, the oven door 26 has a thickness T defined between a back wall 34 and a front wall 36 between which is insulation 38.

Figure 2:
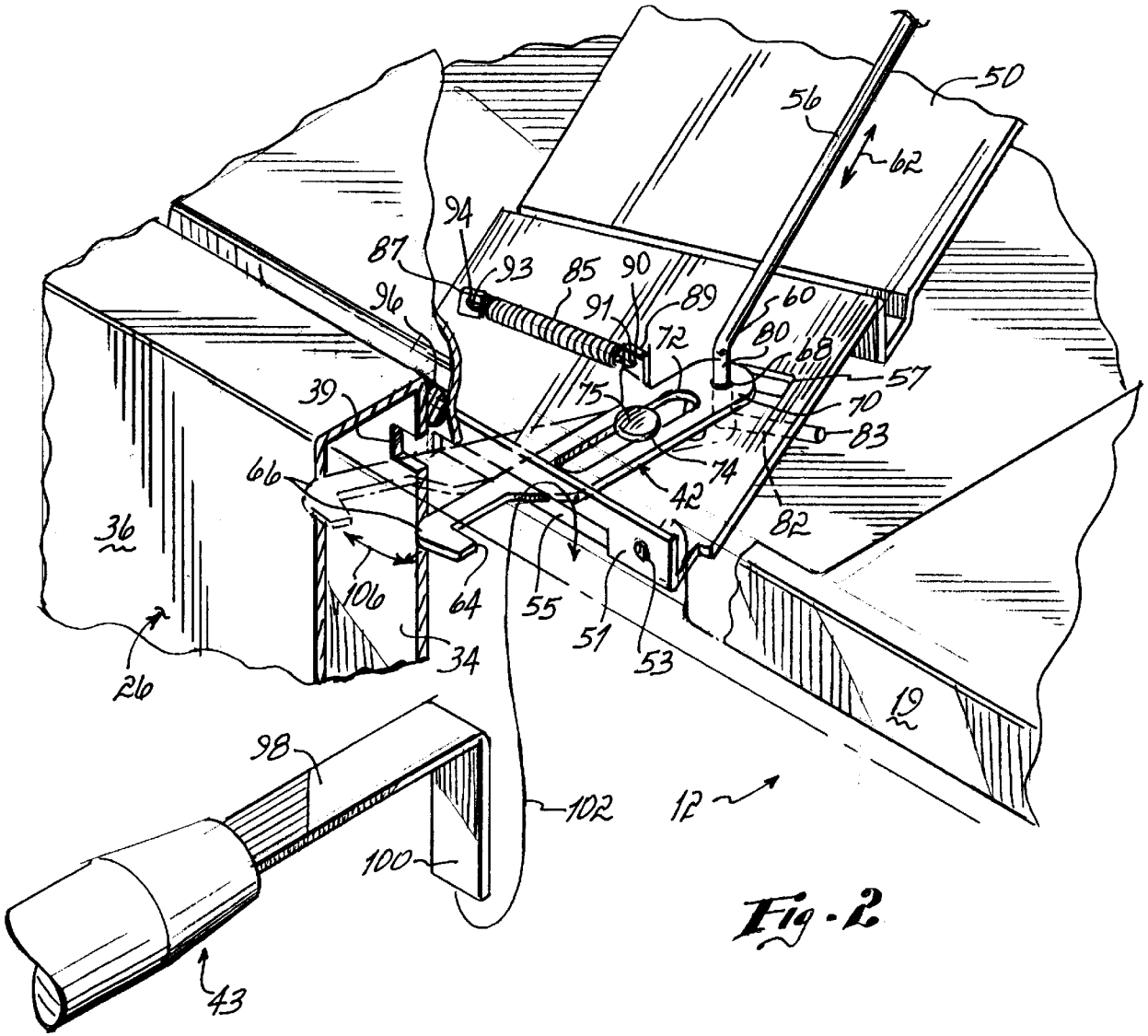
FIG. 2 is an enlarged view of a portion of the front edge of the range of FIG. 1 with a pry bar-type tool illustrated being used to open the oven door.
Figure 3:
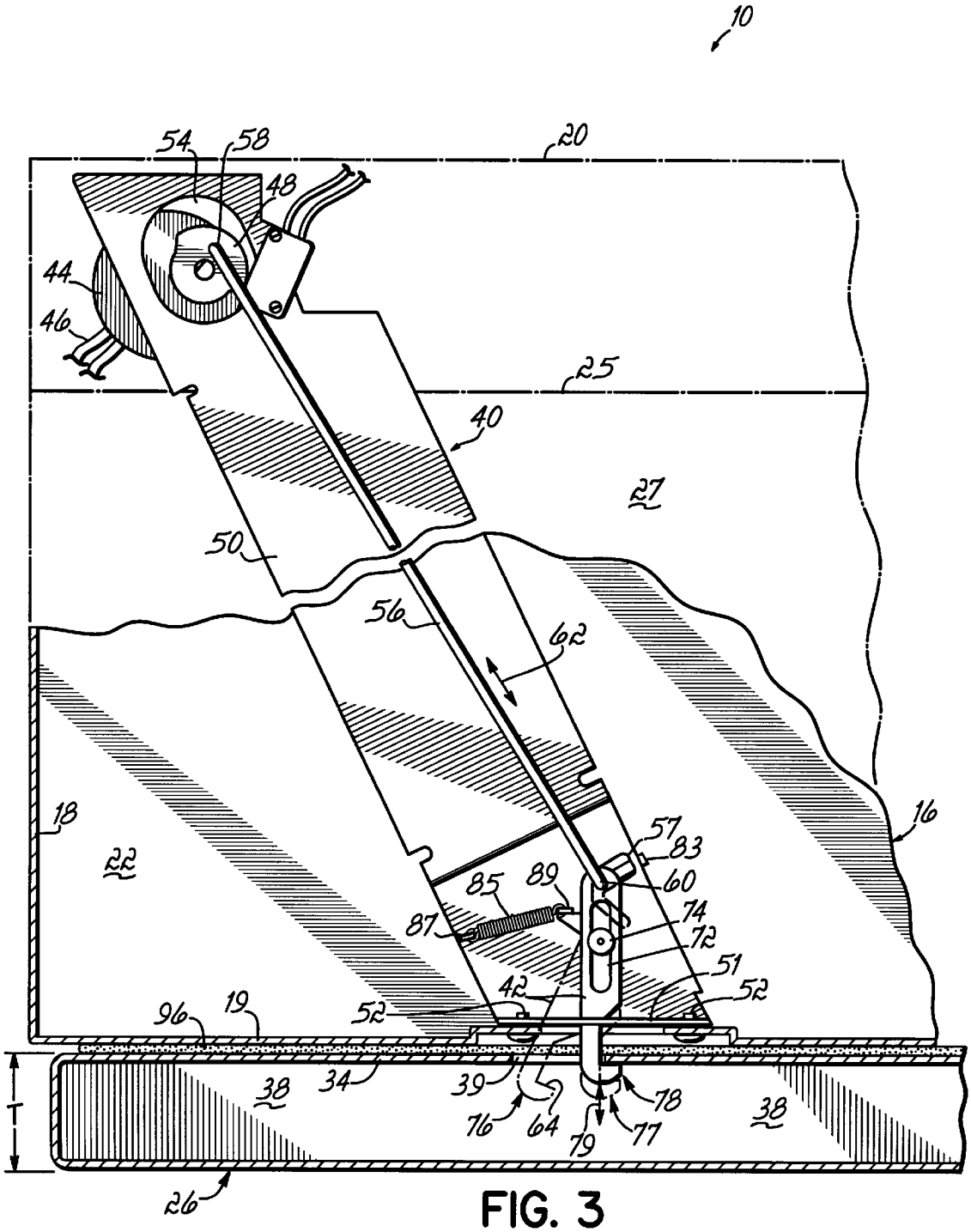
FIG. 3 is a cross-sectional view taken on line 3—3 of FIG. 1, depicting the motorized oven door latch assembly of the present invention.
Figure 4:
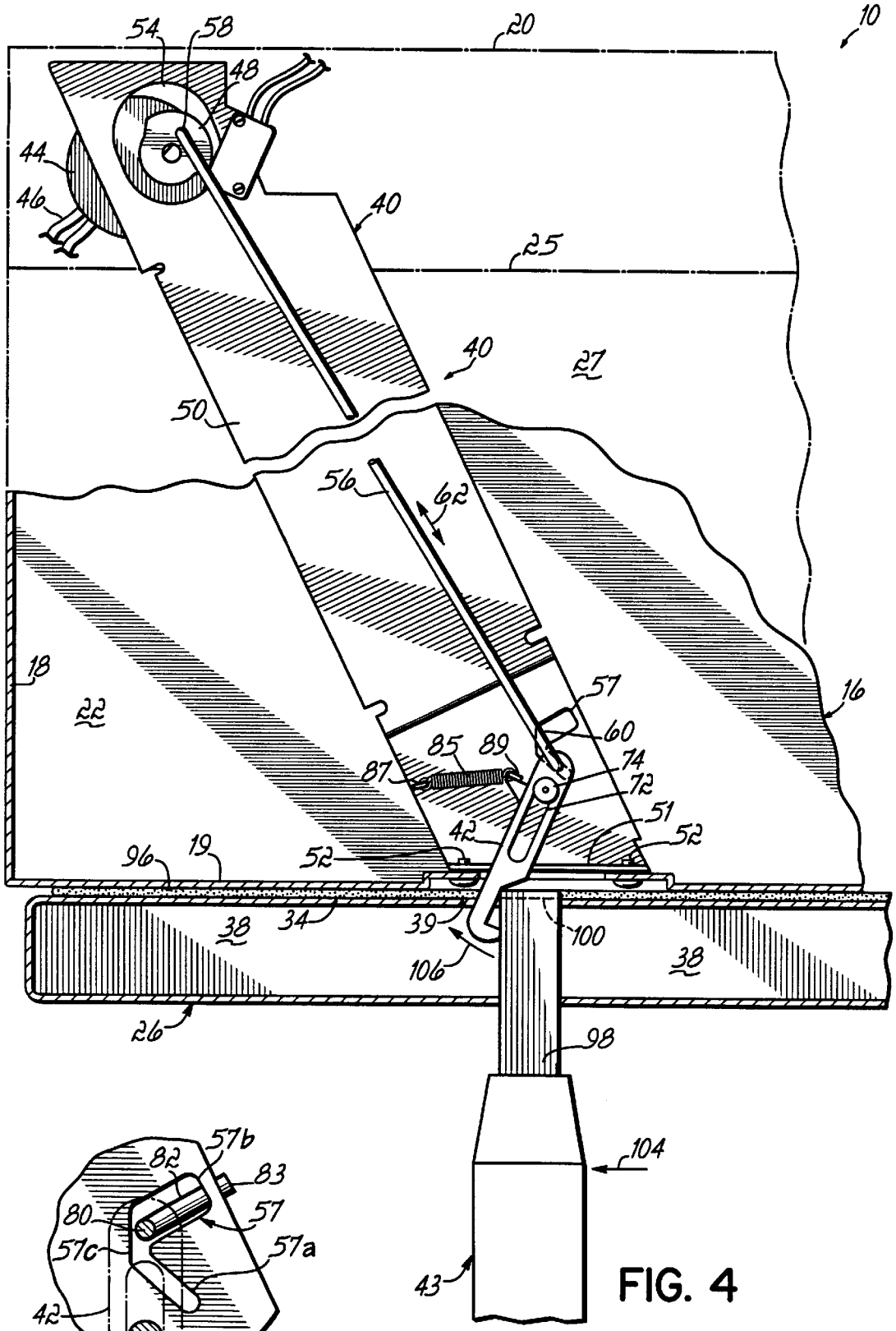
FIG. 4 is a cross-sectional view similar to FIG. 3 but illustrating a pry bar-type tool being used to open the range.

As best illustrated in FIGS. 2–4, a door latch assembly 40 functions to lock the oven door 26 in a closed and sealed position so that the oven door 26 may not be opened e.g. when the oven is in a self-cleaning mode. The door latch assembly 40 comprises multiple components which work together to move a latch plate 42, best illustrated in FIG. 2, between three different positions so that the oven door may be opened when the latch plate is in a first position and the oven door may not be opened when the latch plate is in either its second or third positions without a pry bar-type device or tool 43.

The door latch assembly 40 comprises a motor 44 activated by power lines 46 and located generally behind the rear wall 25 of the oven cavity 24. A cam 48 is secured to the motor 44 such that rotation of the motor causes the cam 48 to rotate about a vertical axis.

A mounting plate 50 extends generally from the back of the range to the front of the range and is secured to the front wall 19 of the range with fasteners 52 (see FIGS. 3 and 4). The mounting plate 50 is located below the top 21 of the range and above the top wall 22 of the oven cavity. An opening 54 in the mounting plate 50 allows the cam 48 to freely rotate when activated by the motor 44. The mounting plate 50 is supported by the range body above the oven cavity 24 in a generally horizontal orientation as seen in FIGS. 1 and 2. Although FIG. 1 illustrates mounting plate 50 being located in a particular orientation, the mounting plate 50 may be placed in other locations as well without departing from the spirit of the invention of this application. As best illustrated in FIG. 2, the mounting plate 50 has a vertically oriented front lip 51. The front lip 51 abuts the front wall 19 of the range body and has a pair of holes therein 53 through which the fasteners 52 pass to secure the front lip 51 of the mounting plate 50 to the front wall 19 of the range body. Additionally, the front lip 51 of the mounting plate has a generally rectangular opening 55 through which the latch plate 42 passes.

Figure 5:
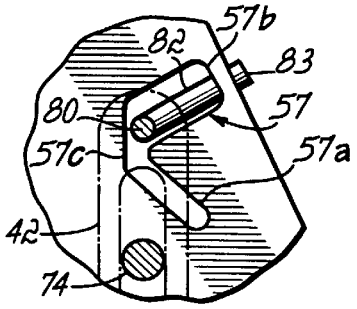
FIG. 5 is an enlarged view of a portion of the mounting plate of the motorized door assembly illustrating the configuration of the guide.

As best illustrated in FIGS. 3, 4 and 5, a guide 57 is located at the front of the mounting plate 50. The guide 57 is an opening of a particular configuration illustrated in detail in FIG. 5 comprising a narrow front section **57*i* a and a relatively wider back section 57*b* between which is located a middle section 57*c*. The size and configuration of the guide 57 limit the movement of the latch plate 42** in a manner described in more detail below.

As best illustrated in FIGS. 2–4 , a latch rod 56 extends between the cam 48 and the latch plate 42, extending generally from front to back of the range. The latch rod 56 has a first end 58 which is secured to the cam 48 and a second end 60 which is secured to the latch plate 42 in a manner which will be described in more detail below. The latch rod 56 is located generally above the mounting plate 50 and moves in a linear manner depicted by the arrows 62 (shown in FIGS. 3 and 4) as the cam 48 rotates.

Another component of the door latch assembly 40 is the latch plate 42 best illustrated in FIG. 2. The latch plate 42 has a hook 64 located at a front end 66, and a hole 68 at a rear end 70. Between the front and back ends the latch plate 42 has a slot 72 therethrough adapted to receive a pin 74. The pin 74 is secured to the mounting plate 50 and extends upwardly therefrom in a fixed location. The pin 74 has a circular top portion 75 which prevents the latch plate 42 from being pulled out of position. The top portion 75 of the pin 74 rests on top of the slot 72 of the latch plate 42, while the pin 74 travels inside the slot as the latch plate moves between positions.

As best illustrated in FIGS. 2 and 3, the latch plate 42 is movable between three positions: a first position 76, a second position 77 and a third position 78. The first position 76 of the latch plate 42 is shown in dashed lines in FIGS. 2 and 3 (to the left). In this first position, the hook 64 of the latch plate 42 is aligned with an opening 39 in the back wall 34 of the oven door (see FIGS. 2 and 3). With the latch plate 42 in this first position, the oven door 26 may be freely opened, the hook 64 of the latch plate 42 passing through the opening 39 in the oven door 26. As the latch rod 56 translates rearwardly due to activation of the motor and consequent rotation of the cam 48, the latch plate 46 moves to its second position, which is shown in dashed lines in FIG. 3. In this position, the oven door 26 may not be opened because the hook 64 of the latch plate 42 catches the back wall 34 of the oven door 26 in a manner depicted in FIG. 3. Upon further rearward translation of the latch rod 56, the latch plate 42 is pulled rearwardly in the direction of arrow 79 to its third position in which the oven door 26 is locked and sealed. In this position, the oven door 26 is correctly sealed and seated so as to provide a tight seal for the oven cleaning process. The third position of the latch plate 46 is shown in solid lines in FIGS. 2 and 3.

As best illustrated in FIG. 2, the second end 60 of the latch rod 56 comprises a vertical section 80 and a horizontal section 82 which terminates in an end 83. The hole 68 in the latch plate 42 is sized so as to have a diameter slightly larger than the diameter of the vertical section 80 of the latch rod 56 so that the vertical section 80 of the latch rod 56 passes through the hole 68 in the latch plate 46 and through the guide 57 in the mounting plate 50 with the horizontal section 82 of the latch rod 56 being located below the mounting plate 50. The horizontal section 82 of the latch rod 56 prevents the latch rod 56 from separating from either the latch plate 42 or the mounting plate 50 as the vertical section 80 of the latch rod 56 moves inside the guide 57 upon translation of the latch rod 56.

In order to bias the latch plate 42 toward its second position, a biaser 85 (best illustrated in FIG. 2) extends between a bracket 87 fixedly secured to the front of the mounting plate 50 and a finger 89 of the latch plate 42. The finger 89 of the latch plate extends vertically and has a hole 90 therein through which a hook 91 of the biaser 85 passes in order to secure one end of the biaser 85 to the latch plate. The other end of the biaser 85 has a hook 93 which passes through a hole 94 in the bracket 87. Although biaser 85 is illustrated as being a spring, the biaser 85 may be any other biasing-type mechanism and may be secured at either end with structures other than hooks to the latch plate 42 and to the bracket 87, respectively.

In operation, upon activation of the motor, the cam 48 rotates, causing the latch rod 56 to translate along the direction of arrows 62. Upon rearward translation of the latch rod 56, the latch plate 42 moves from its first position 76 to its second position 77 in which the oven door is prevented from opening. Upon further translation of the latch rod, the latch plate is pulled rearwardly to its third position 78 in which the oven door 26 is in a locked and sealed position with the back wall 34 of the oven door exerting pressure against a gasket 96 located between the oven door 26 and the front wall 19 of the range body (see FIGS. 2 and 3).

In the event of an electrical or mechanical failure while the oven is in a self-cleaning mode and the oven door 26 is in a locked and sealed position, the latch rod 56 will not translate. Thus, the latch plate 42 is fixed in its third position. In heretofore known range door assemblies, a service technician had to be called in order to access the latch rod 56 through the back of the range in order to open the oven door 26 so that the oven could be used for cooking. With the present invention, a pry bar-type device or tool 43 having a horizontal section 98 and a vertical section 100 may be used to open the oven door 26 without having to call a service technician and without having to access the oven cavity through the rear panel of the range.

As best illustrated in FIGS. 2 and 4, the vertical section 100 of the pry bar tool 43 is moved in the direction of arrow 102 such that the vertical section 100 is pried between the oven door 26 and the front wall of the range body to the right of the latch plate. By moving the tool 43 in the direction of arrow 104, as shown in FIG. 4, pressure is exerted on the latch plate, pushing the front end of the latch plate in the direction of arrow 106 (to the left), as seen in FIGS. 2 and 4, towards its first position. By moving the pry bar tool 43 in this direction, the latch plate 42 is moved against the bias of the biaser 85 causing the rear of the latch plate 42 to move in a forward and sideways direction as dictated by the configuration of the guide 57 formed in the mounting plate 50. As best illustrated in FIG. 4, the latch plate 42 rotates and slides about the pin 74 and the pin moves inside the slot 72 so that the latch plate 46 is moved to its first position. With the latch plate 42 in its first position 76, the oven door 26 may be opened.

Thus, with the present invention an operator may quickly and easily open the oven door even in the event of a mechanical or electrical failure. Consequently, the oven may be used for cooking immediately and is not inoperable for an extended period of time (until a service technician comes to fix the cause of the failure).

While I have described one preferred embodiment of the present invention, persons skilled in the art will appreciate changes and modifications which may be made to the present invention without departing from the scope of the invention. Therefore, I do not intend to be limited except by the scope of the following claims.

I claim:

1. A motorized door latch assembly for locking an oven door in a closed position so as to close an oven cavity for purposes of cleaning said oven cavity, said oven door being mounted on a range body and being movable between an open and said closed position, said door latch assembly comprising:

a mounting plate supportable by said range body above said oven cavity, said mounting plate having a guide therethrough, a pin extending upwardly from said mounting plate, a motor, a cam rotatably driven by said motor, a latch rod secured to said cam at a first end and secured to a latch plate at a second end, said second end of said latch rod passing through said guide of said mounting plate, said latch plate being adapted to engage said oven door and being movable between a first position in which said oven door may be opened and a second position in which said oven door may not be opened, said pin extending through a slot in said latch plate to restrict movement of said latch plate, a biaser extending between a fixed point on said mounting plate and said latch plate so as to bias said latch plate toward said second position, and wherein upon rotation of said cam by said motor, said latch rod translates, moving said latch plate between said first and second positions.

2. The motorized door latch assembly of claim 1 wherein said second end of said latch rod comprises a vertical section and a horizontal section, said vertical section extending through said hole in said latch plate and said guide in said mounting plate, said horizontal section being below said mounting plate.

3. The motorized door latch assembly of claim 1 wherein said latch plate is movable to a third position upon further translation of said latch rod.

4. The motorized door latch assembly of claim 1 wherein said latch plate has a hole therethrough, said second end of said latch rod passing through said hole of said latch plate to secure said second end of said latch rod to said latch plate.

5. The motorized door latch assembly of claim 1 wherein said latch rod extends generally from back to front of said range.

6. A motorized door latch assembly for locking an oven door in a closed position, said oven door being mounted on a range body and being movable between an open and closed position, said door latch assembly comprising:

a mounting plate supportable by said range body above an oven cavity, said mounting plate having a guide therethrough and a pin extending upwardly from said mounting plate, a cam rotatably driven by a motor, a latch rod secured to said cam at a first end and secured to a latch plate at a second end being movable between a first position in which said oven door may be opened and a second position in which said hook of said latch plate engages said oven door preventing said oven door from opening, said latch plate having a hook at one end for engaging said range door and a hole at the other end, said second end of said latch rod passing through said hole of said latch plate and through said guide, a biaser extending between a fixed point on said mounting plate and said latch plate, said biaser urging said latch plate towards said second position, wherein upon rotation of said cam by said motor, said latch rod translates, moving said latch plate between said positions, said pin extending through a slot in said latch plate to restrict movement of said latch plate as said latch plate moves between said first and second positions.

7. The motorized door latch assembly of claim 6 wherein said latch plate may be moved from said second position to said first position without translation of said latch rod by applying pressure upon said hook of said latch plate against bias created by said biaser.

8. The motorized door latch assembly of claim 6 wherein said biaser is a spring.

9. A motorized door latch assembly for locking an oven door in a closed position so as to close an oven cavity for purposes of cleaning said oven cavity, said oven door being mounted on a range body, said door latch assembly comprising:

a mounting plate supportable by said range body above said oven cavity, said mounting plate having a guide therethrough, a pin extending upwardly from said mounting plate, a motor, a cam rotatably driven by said motor, a latch rod extending generally from back to front of said range body above said oven cavity, said latch rod being secured to said cam at one end and secured to a latch plate at the other end, said latch plate having a hook at one end for engaging said oven door, a biaser extending between a fixed point on said mounting plate and said latch plate, and wherein upon rotation of said cam by said motor, said latch rod translates, moving said latch plate between a second position in which said hook of said latch plate engages said oven door preventing said oven door from opening and a first position in which said oven door may be opened, said pin extending through a slot in said latch plate to restrict movement of said latch plate as said latch plate moves between said first and second positions, said latch plate being movable from said second position to said first position so said oven door may be opened without translation of said latch rod.

10. A motorized door latch assembly for locking an oven door in a closed position so as to close an oven cavity for purposes of cleaning said oven cavity, said oven door being mounted on a range body, said door latch assembly comprising:

a mounting plate supportable by said range body above said oven cavity, said mounting plate having a guide therethrough, a pin extending upwardly from said mounting plate, a motor, a cam rotatably driven by said motor, a latch rod extending generally from back to front of said range above said oven cavity, said latch rod being secured to said cam at one end and secured to a latch plate at the other end, said latch plate having a hook at one end for engaging said oven door, a biaser extending between a fixed point on said mounting plate and said latch plate, and wherein upon rotation of said cam by said motor, said latch rod translates, moving said latch plate between three positions, a first position in which said oven door may be opened, a second position in which said oven door may not be opened and a third position in which said oven door is locked and sealed.

* * * * *